US006560415B2

(12) United States Patent
Hirako et al.

(10) Patent No.: US 6,560,415 B2
(45) Date of Patent: May 6, 2003

(54) IMAGE FORMATION APPARATUS AND METHOD FOR CONTROLLING A PAPER STOP POSITION

(75) Inventors: Naoki Hirako, Ebina (JP); Yoshiyuki Mizuki, Ebina (JP); Takashi Nagai, Ebina (JP); Yuichi Deguchi, Ebina (JP); Shinya Utsushikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/986,420

(22) Filed: Nov. 8, 2001

(65) Prior Publication Data

US 2002/0071684 A1 Jun. 13, 2002

(30) Foreign Application Priority Data

Dec. 8, 2000 (JP) ..... 2000-373838

(51) Int. Cl.[7] ..... G03G 15/00
(52) U.S. Cl. ..... 399/18; 399/21
(58) Field of Search ..... 399/18–21

(56) References Cited

U.S. PATENT DOCUMENTS 5,328,168 A * 7/1994 Fox ..... 399/21 X
5,815,766 A * 9/1998 Miller et al. ..... 399/21
6,205,297 B1 * 3/2001 Tachibana et al. ..... 399/21

FOREIGN PATENT DOCUMENTS

JP 2-163244 A 6/1990
JP 7-314857 A 12/1995
JP 9-34197 A 2/1997
JP 9-281762 A 10/1997
JP 10-310335 A 11/1998

* cited by examiner

*Primary Examiner*—William J. Royer
(74) *Attorney, Agent, or Firm*—Oliff & Berridge PLC

(57) ABSTRACT

As a control method of an image formation apparatus 1 having an image formation apparatus main unit 2 and a postprocessing unit 3, when paper jam (1) occurs in the postprocessing unit 3, paper jam (2) is caused to occur at a paper ejection position at the last stage in the image formation apparatus main unit 2 and the paper stop position is controlled in the image formation apparatus main unit 2 based on the paper jam (2).

12 Claims, 8 Drawing Sheets

IMAGE FORMATION APPARATUS AND METHOD FOR CONTROLLING A PAPER STOP POSITION

BACKGROUND OF THE INVENTION

1. Field of the Invention

This invention relates to an image formation apparatus such as a copier or a printer and method for controlling the same and in particular to an art of controlling a paper stop position when an anomaly of a paper jam occurs.

2. Description of the Related Art

In recent years, demands for forming an image on paper having various sizes, thicknesses, and paper qualities (coated paper, cardstock, transparencies, or the like) have been made for an image formation apparatus such as a copier or a printer. To transport various types of paper in an image formation apparatus, it is necessary to control a position of paper being transported in response to the paper type. For example, to transport thick paper, the pitch interval of paper (reference timing of delivering paper) is extended more than that to transport thin paper or in case of forming an image on both sides of paper (double-sided copying), the pitch interval of paper is thinned out for controlling the position of paper being transported. Thus, the positions of paper being transported in the image formation apparatus have various patterns.

When an anomaly of a paper jam occurs during an operation of the image formation apparatus and it becomes necessary to stop transporting paper accordingly, if transporting the paper is stopped at the same time as the anomaly occurs, it is feared that the paper stop position may become improper. For example, if the paper being transported is stopped at the same time as a paper jam occurs (is detected), it is also assumed that when the jammed paper is removed, the paper stopped at an improper position will be torn off and a paper piece that cannot be removed will remain in the apparatus, resulting in an inoperable state. Thus, if an anomaly as described above occurs, control is performed so as to stop the paper at a position where the paper can be removed easily. To realize such paper stop position control, it is necessary to predetermine which positions paper should be stopped at in response to anomaly contents (for example, if the anomaly is a paper jam, the occurrence point) and a position of the paper being transported at a time when the anomaly occurs.

By the way, a postprocessing unit for taking paper on which an image is already formed therein to perform postprocessing of collating, stacking, stapling or the like may be added to a main unit of an image formation apparatus. In such a case, if a paper jam occurs in the postprocessing unit attached (joined) to the main unit of the image formation apparatus, it becomes almost impossible to locate the paper position in the main unit of the image formation apparatus. Thus, it is impossible to stop the paper being transported at a proper position in the main unit of the image formation apparatus. Then, to remove the jammed paper, it is feared that a paper piece remains that cannot be removed because of torn-off paper as described above.

In the case of a paper jam occurring in the main unit of the image formation apparatus, the position of paper being transported varies depending on the paper type and thus if an attempt is made to properly control the stop positions of all types of paper, the paper stop patterns also become various and it becomes extremely intricate to control stopping paper.

SUMMARY OF THE INVENTION

An object of the invention is to solve the above described problems.

According to the invention, there is provided an image formation apparatus comprising a first apparatus unit having a first paper transport passage; a second apparatus unit having a second paper transport passage for passing paper to/from the first paper transport passage; and a controller, wherein the controller causes a paper jam to occur in the first apparatus unit when an anomaly requiring that paper transporting be stopped in the second apparatus unit; and the controller controls a paper stop position in the first apparatus unit based on the paper jam caused to occur.

In the image formation apparatus having the above described configuration, if an anomaly requiring that paper transporting be stopped (for example, a paper jam) occurs in the second apparatus unit, the controller causes a paper jam to occur in the first apparatus unit, and the controller controls the paper stop position in the first apparatus unit based on the paper jam. Accordingly, it is made possible to appropriately control the paper stop position in the first apparatus unit regardless of the timing at which an anomaly occurs in the second apparatus unit.

According to the invention, there is provided a control method of an image formation apparatus comprising a first apparatus unit having a first paper transport passage and a second apparatus unit having a second paper transport passage for passing paper to/from the first paper transport passage, the control method comprising the steps of: causing a paper jam to occur in the first apparatus unit when an anomaly requiring that paper transporting be stopped in the second apparatus unit; and controlling a paper stop position in the first apparatus unit based on the paper jam.

In the control method of the image formation apparatus, when an anomaly requiring that paper transporting be stopped occurs in the second apparatus unit, a paper jam is caused to occur in the first apparatus unit, and the paper stop position in the first apparatus unit is controlled based on the paper jam. Thus, it is made possible to appropriately control the paper stop position in the first apparatus unit regardless of the timing at which an anomaly occurs in the second apparatus unit.

DETAILED DESCRIPTION OF THE PREFERRED EMBODIMENTS

Referring now to the accompanying drawings, a preferred embodiment of the invention will be described in detail.

Figure 1:
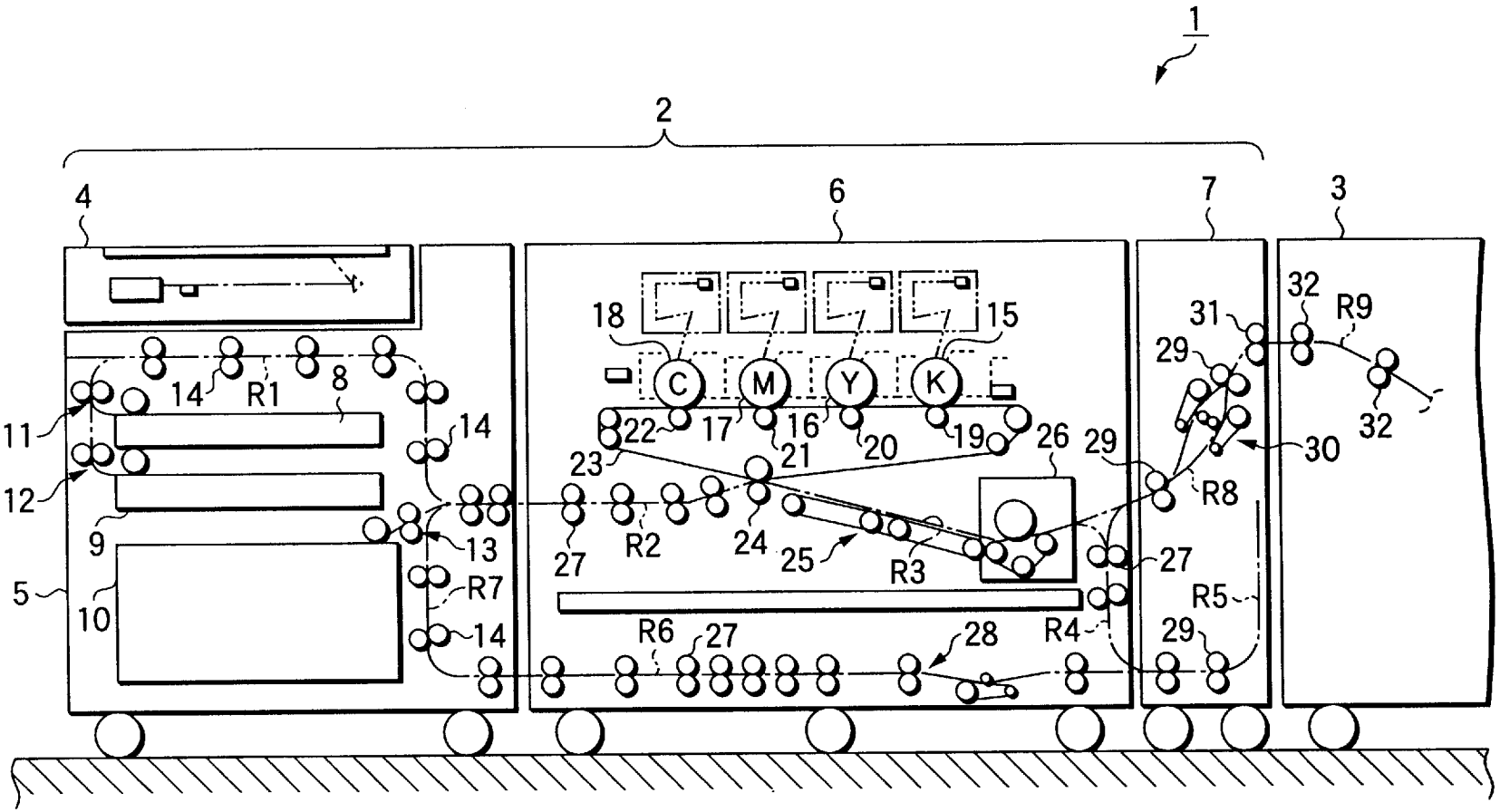
FIG. 1 is a schematic diagram to show a whole configuration of an image formation apparatus to which the invention is applied.

FIG. 1 is a schematic diagram to show a whole configuration of an image formation apparatus 1 to which the invention is applied. The image formation apparatus 1 shown in the figure is a full-color digital copier and is roughly made up of an image formation apparatus main unit 2 and a postprocessing unit 3 added (attached) thereto. Further, the image formation apparatus main unit 2 is made up of an image read unit 4, a paper feed unit 5, an image formation unit 6, and a paper ejection unit 7.

The image read unit 4 reads an image of an original set on a transparent original bed (platen glass). The image read unit 4 comprises an optical scanning system made up of, for example, a lamp, a mirror, a carriage, and the like, a lens system for focusing an optical image read and scanned by the optical scanning system, and an image read sensor (for example, a CCD sensor) for receiving the optical image focused by the lens system to convert the received optical image into an electric signal.

The paper feed unit 5 supplies paper on which an image is to be formed to the image formation unit 6. The paper feed unit 5 is provided with three paper trays 8, 9, and 10 for storing paper. Delivery rollers 11, 12, and 13 are disposed in the proximities of the paper trays 8, 9, and 10, respectively. The delivery rollers 11, 12, 13 nip and temporarily stop paper sent from the corresponding paper tray 8, 9, 10 in a manner to be separated one by one and deliver the paper at a predetermined timing from the stop position. The paper feed unit 5 is formed with paper transport passages R1 and R7 and a plurality of transport rollers 14 are disposed along the paper transport passages R1 and R7. The paper transport passages R1 and merge with each other a little before a paper passing point to the image formation unit 6 (upstream in a transport direction).

The image formation unit 6 forms an image on paper supplied from the paper feed unit 5. The image formation unit 6 is of a quadplex tandem configuration comprising four photoconductor drums 15, 16, 17, and 18 corresponding to colors of K (black), Y (yellow), M (magenta), and C (cyan), four primary transfer rollers 19, 20, 21, and 22 corresponding to the photoconductor drums 15, 16, 17, and 18, an intermediate transfer belt 23, a secondary transfer roller 24, a vacuum transport section 25, and a fuser 26.

A charger, a laser writer (laser ROS), a developing device, a cleaner, and the like are placed surrounding each of the photoconductor drums 15, 16, 17, and 18. The charger charges a surface of the photoconductor drum uniformly, and the laser writer applies laser to the surface of the photoconductor drum charged by the charger to form an electrostatic latent image. The developing device supplies toner as a developer to the surface of the photoconductor drum to visualize (develop) the electrostatic latent image to form a toner image, and the cleaner removes unnecessary toner remaining on the photoconductor drum.

On the other hand, the four primary transfer rollers 19, 20, 21, and 22 are placed to face the corresponding photoconductor drums 15, 16, 17, and 18 in the proximities thereof through the intermediate transfer belt 23. The primary transfer rollers 19, 20, 21, and 22 transfer (primarily transfer) the toner images formed on the photoconductor drums 15, 16, 17, and 18 as described above to the intermediate transfer belt 23. The intermediate transfer belt 23 is placed like a loop on a plurality of (in an example shown in the figure, five) belt support rollers.

The secondary transfer roller 24 is placed to face the intermediate transfer belt 23. The secondary transfer roller 24 transfers (secondarily transfers) the toner images transferred to the intermediate transfer belt 23 as described above to paper. The vacuum transport section 25 transports the paper to which the toner image is transferred by the secondary transfer roller 24 to the fuser 26. The fuser 26 fixes the toner image on the paper by heat, pressure, or any other fixing means known in the art.

The image formation unit 6 is formed with paper transport passages R2, R3, R4, and R6 and a plurality of transport rollers 27 are disposed along the paper transport passages R2, R3, R4, and R6. However, in the paper transport passage R3, the paper is transported by the vacuum transport section 25 and thus the transport rollers 27 are not placed. A curl correction section 28 is provided at a midpoint in the paper transport passage R6 for correcting a curl of paper occurring when the paper passes through the fuser 26.

The paper ejection unit 7 ejects paper on which an image is formed by the image formation unit 6. The paper ejection unit 7 is formed with paper transport passages R5 and R8 and a plurality of transport rollers 29 are disposed along the paper transport passages R5 and R8. The paper transport passage R8 is bifurcated at a midpoint where a curl correction section 30 is provided. Discharge rollers 31 are disposed in the most downstream part of the paper transport passage R8. The discharge rollers 31 discharge (send) paper from the image formation apparatus main unit 2 to the postprocessing unit 3 and serves as the paper transport means at the last stage in the image formation apparatus main unit 2 for passing paper to the postprocessing unit 3. In this connection, if the postprocessing unit 3 is not attached to the image formation apparatus main unit 2, a discharge tray (not shown) is attached to a discharge position where paper is ejected by the discharge rollers 31.

The postprocessing unit 3 receives paper on which an image is already formed, and performs predetermined processing (for example, collating, stacking, stapling, or the like). The postprocessing unit 3 is formed with a paper transport passage R9 and a plurality of transport rollers 32 are disposed along the paper transport passage R9.

A basic operation of the image formation apparatus having the described configuration will be given. First, paper stored in the upper paper tray 8 and the intermediate paper tray 9 is delivered by the corresponding delivery rollers 11 and 12, respectively and then is transported along the paper transport passage R1 by the transport rollers 14 and is fed into the merge part with the paper transport passage R7. On the other hand, paper stored in the lower paper tray (large-capacity tray) 10 is fed directly into the merge part of the paper transport passages R1 and R7 by the deliver rollers 13.

The paper thus fed into the merge part of the paper transport passages R1 and R7 is passed to the image formation unit 6. The paper passed to the image formation unit 6 is fed into an image formation position (between the intermediate transfer belt 23 and the secondary transfer roller 24) along the paper transport passage R2 by the transport rollers 27. The paper passed through the image formation position is transported along the paper transport passage R3 by the vacuum transport section 25 and then is fed into the fuser 26. Further, the paper passed through the fuser 26 is passed to the paper ejection unit 7. The paper passed to the paper ejection unit 7 is transported along the paper transport passage R8 by the transport rollers 29 and then is passed to the postprocessing unit 3 by the discharge rollers 31. The paper passed to the postprocessing unit 3 is transported along the paper transport passage R9 by the transport rollers 32 and is fed into a predetermined processing position.

On the other hand, paper having double sides on which an image is formed passes through the fuser 26 and then is transported along the paper transport passage R4. After this, the paper is once fed into the paper transport passage R5 on the side of the paper ejection unit 7 from the paper transport passage R4 and is switched back into the paper transport passage R6 of the image formation unit 6. Next, the paper is transported along the paper transport passage R6 and then is fed into the paper transport passage R7 on the side of the paper feed unit 5 through which the paper is fed into the merge part with the paper transport passage R1. After this, the paper is sent via the paper transport passages R2 and R3 to the fuser 26 and further is transported from the fuser 26 via the paper transport passages R8 and R9 in a similar manner to that described above.

On the other hand, the image read unit 4 reads an image of an original by optical scanning and the image formation unit 6 forms a toner image based on an image signal provided by reading the image by optical scanning. That is, while rotating the four photoconductor drums 15, 16, 17, and 18, the image formation unit 6 forms K, Y, M, and C toner images on the surfaces of the photoconductor drums 15, 16, 17, and 18 by the chargers, the laser writers (laser ROS), and the developing devices corresponding to the photoconductor drums. The color toner images thus formed are superposed on each other in order as they are transferred to the intermediate transfer belt 23 by the primary transfer rollers 19, 20, 21, and 22. Accordingly, a multicolor (full-color) toner image provided by superposing the four color toners on each other is formed on the intermediate transfer belt 23. The toner image thus formed is fed into the image formation position with a move (running) of the intermediate transfer belt 23 and is transferred by the secondary transfer roller 24 to the paper passing through the image formation position. The multicolor toner image thus transferred to the paper, as the paper is transported by the vacuum transport section 25 as described above, is pressurized and heated by the fuser 26 and is fixed on the paper.

Figure 2:
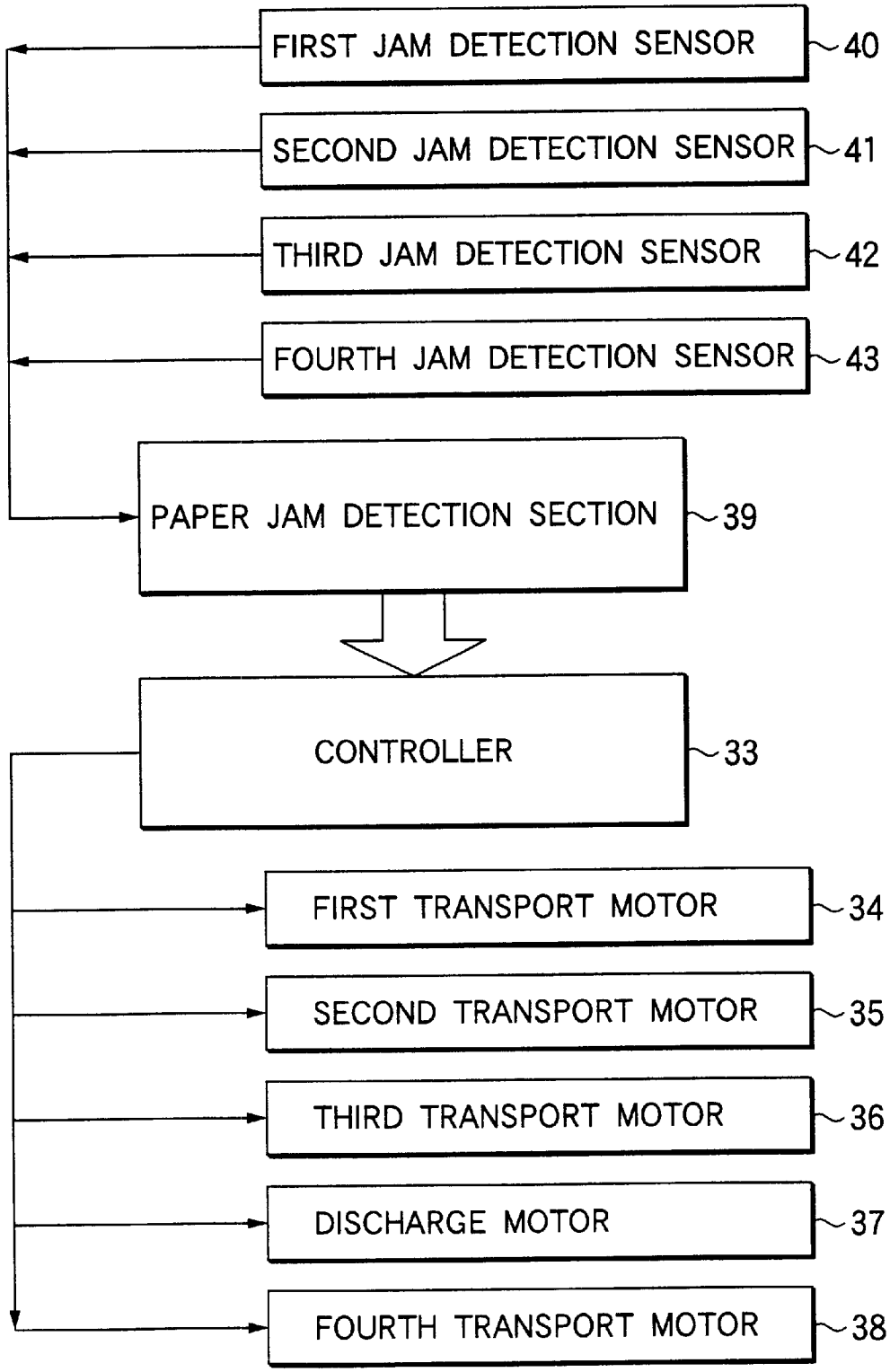
FIG. 2 is a block diagram to show a control configuration of the image formation apparatus according to an embodiment of the invention.

FIG. 2 is a block diagram to show a control configuration of the image formation apparatus according to the embodiment of the invention. In FIG. 2, a controller 33 controls the operation of the whole image formation apparatus. A plurality of motors to be controlled are connected to the controller 33. The first transport motor 34 serves as a drive source for rotating the transport rollers 14 in the paper feed unit 5 and the second transport motor 35 serves as a drive source for rotating the transport rollers 27 in the image formation unit 6. The third transport motor 36 serves as a drive source for rotating the transport rollers 29 in the paper ejection unit 7 and the discharge motor 37 serves as a drive source for rotating the discharge rollers 31 in the paper ejection unit 7. Further, the fourth transport motor 38 serves as a drive source for rotating the transport rollers 32 in the postprocessing unit 3.

A paper jam detection section 39 is also connected to the controller 33. When a paper jam occurs in the image formation apparatus 1, the paper jam detection section 39 detects the paper jam and sends a jam detection signal indicating occurrence of the paper jam to the controller 33. As the controller 33 receives the jam detection signal, the controller can identify a position where the paper jam occurs in the image formation apparatus 1. First to fourth jam detection sensors 40, 41, 42, and 43 are connected to the paper jam detection section 39. The paper jam detection section 39 can also be built in the controller 33 as a function of the controller 33.

The first jam detection sensor 40 detects a paper jam occurring in the paper transport passage R1 or R7 in the paper feed unit 5 and the second jam detection sensor 41 detects a paper jam occurring in the paper transport passage R2, R3, R4, or R6 in the image formation unit 6. The third jam detection sensor 42 detects a paper jam occurring in the paper transport passage R5 or R8 in the paper ejection unit 7 and the fourth jam detection sensor 43 detects a paper jam occurring in the paper transport passage R9 in the postprocessing unit 3. The number of sensors of each of the jam detection sensors 40, 41, 42, and 43 is determined appropriately in each of the units of the apparatus (5, 6, 7, 3). Particularly, in the image formation unit 6, the paper transport passage is formed long and thus the number of sensors placed in the unit is increased.

Figure 3:
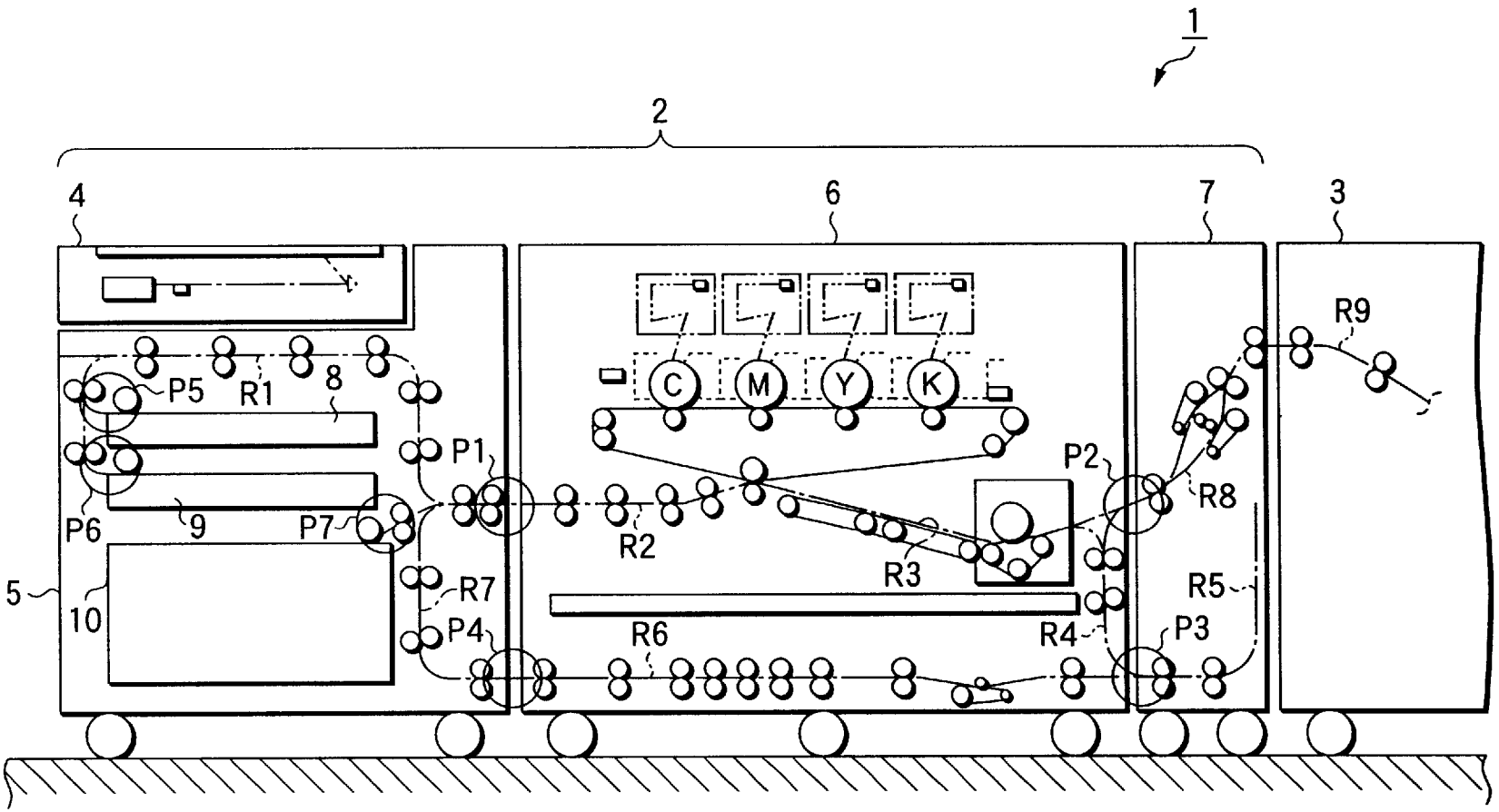
FIG. 3 is a drawing to show paper stop inhibition areas in the image formation apparatus.

When a jam detection signal is output from the paper jam detection section 39, the controller 33 controls the paper stop position based on the jam detection signal. However, in event of controlling the paper stop position, paper stop inhibition areas exist in the image formation apparatus 1. The paper stop inhibition areas are places which will become obstacles to removal of jammed paper if paper is stopped there. Specifically, the paper stop inhibition areas are joint parts of the units, P1, P2, P3, and P4, and paper paying-out parts of the paper trays 8, 9, and 10, P5, P6, and P7 as shown in FIG. 3; each area where paper is placed so as to spread across becomes the paper stop inhibition area.

If paper is stopped in any of the paper stop inhibition areas P1 to P7, for example, if paper is stopped in the paper stop inhibition position P1, when the paper feed unit 5 is detached from the image formation unit 6, a so-called guillotine phenomenon in which paper is torn out occurs; if paper is stopped in the paper stop inhibition position P7, when the paper tray 8 is drawn out, a similar guillotine phenomenon occurs. Thus, the risk of an unremovable paper piece remaining in the image formation apparatus 1, resulting in an inoperable state is increased. Then, when a paper jam occurs, the controller 33 controls so as to move paper to a predetermined position and then stop the paper by appropriately driving the motors 34 to 38 so that the paper does not stop in any of the paper stop inhibition areas P7.

Figure 4:
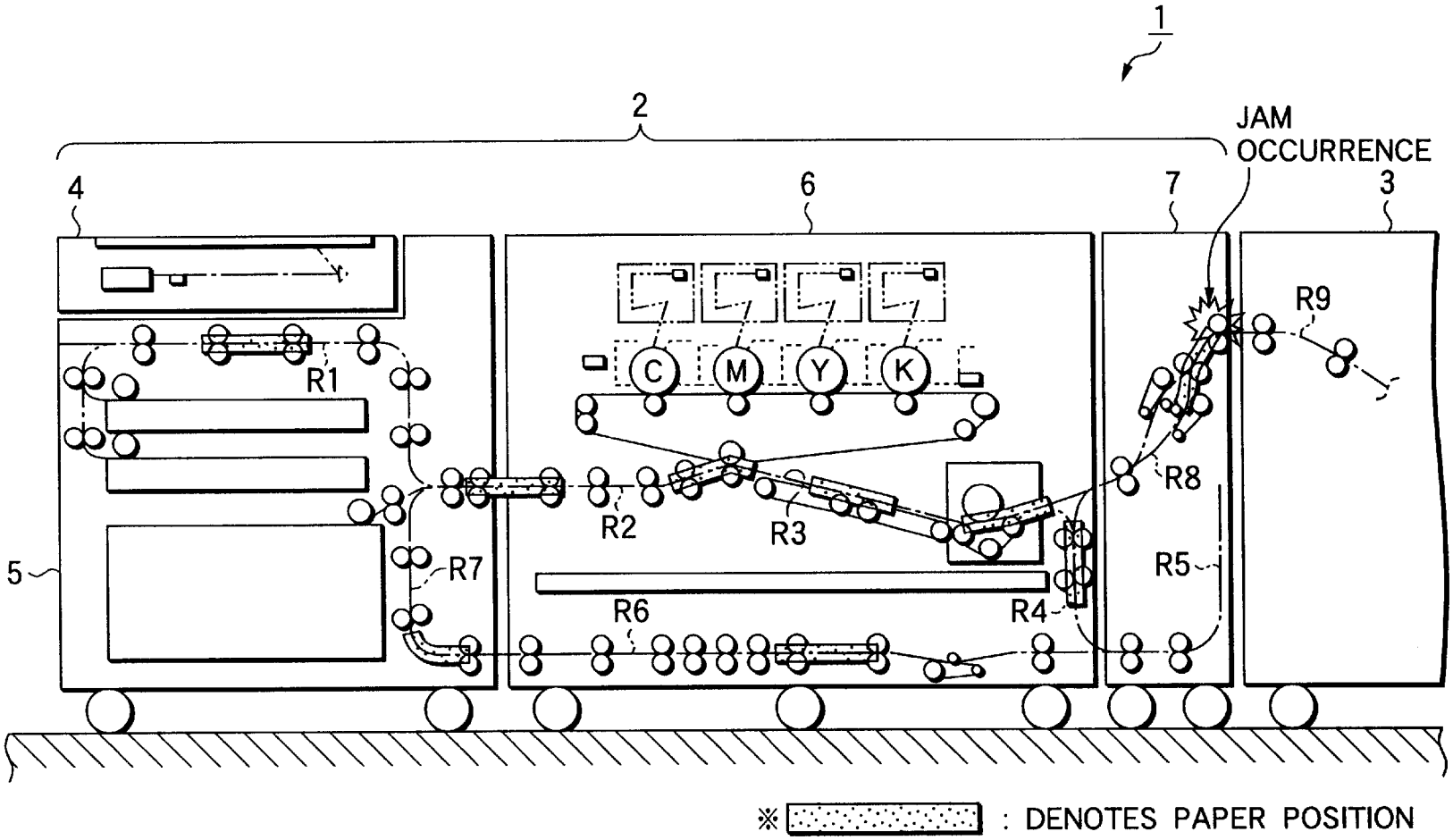
FIG. 4 is a drawing to show an example of positions of paper being transported.
Figure 5:
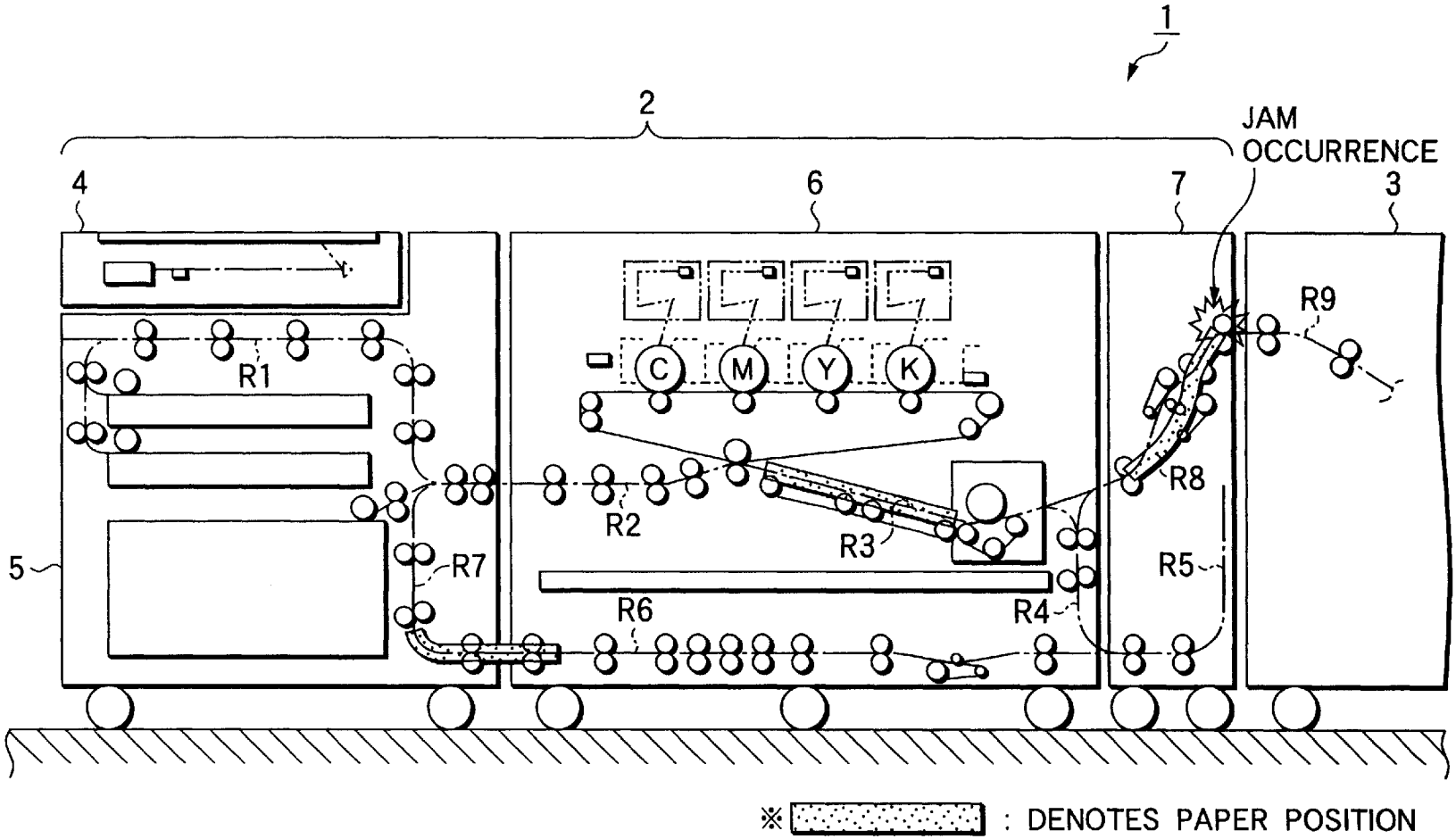
FIG. 5 is a drawing to show another example of positions of paper being transported.
Figure 6:
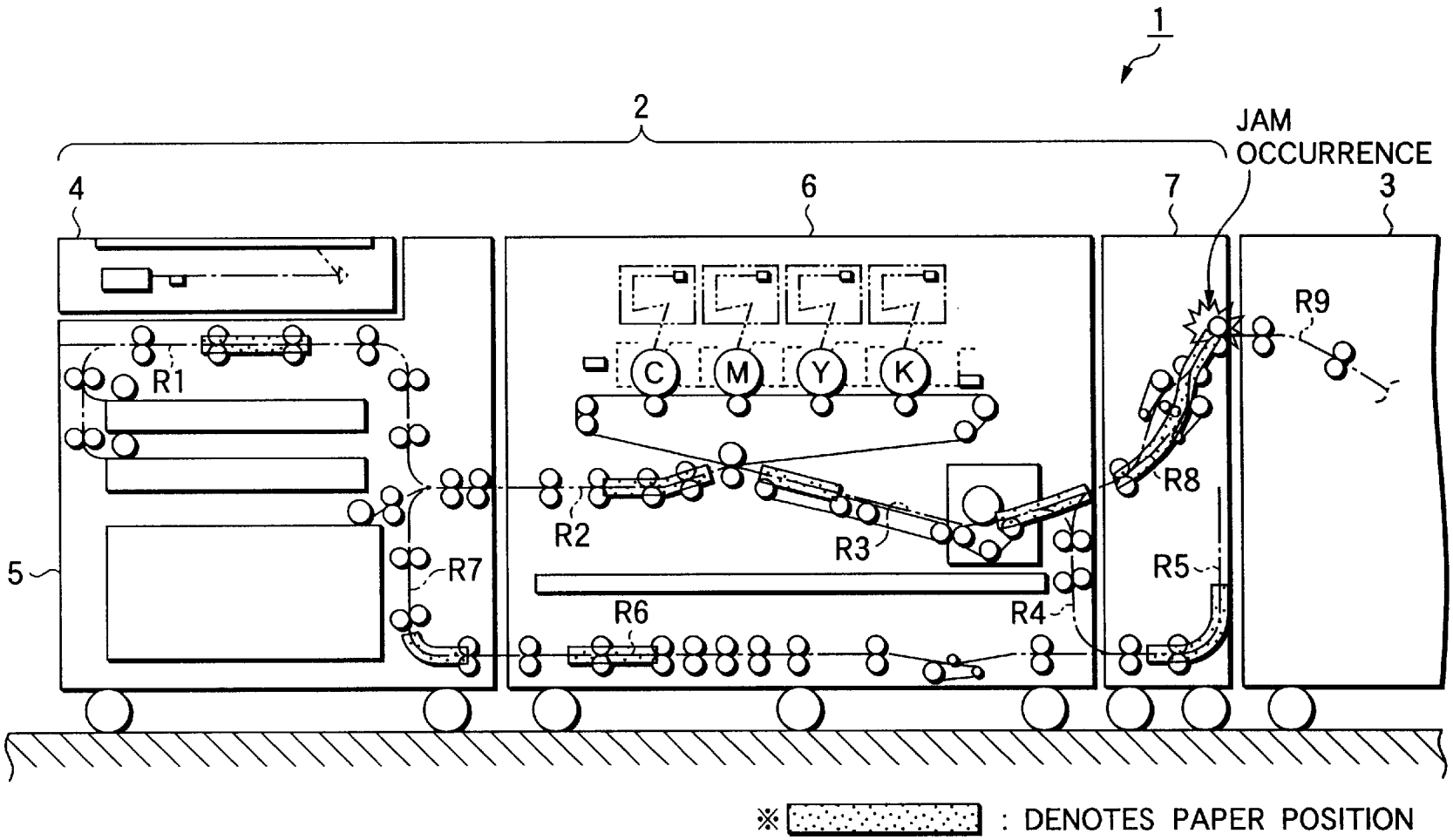
FIG. 6 is a drawing to show paper stop positions when a paper jam occurs.

By the way, if paper transported in the image formation apparatus main unit 2 differs in type (size, thickness, paper quality, etc.,) or orientation, the positions of paper being transported also differ accordingly. For example, to transport A4-size plain paper with a short side part thereof in a direction orthogonal to the transport direction and form an image, hi the positions of the paper being transported become as shown in FIG. 4. In contrast, to transport B4-size plain paper with a short side part thereof in a direction orthogonal to the transport direction and form an image, the positions of the paper being transported become as shown in FIG. 5. Thus, in FIGS. 4 and 5, if a paper jam occurs in a similar manner at the paper ejection position of the paper ejection unit 7, the paper positions at that time become different from each other. Then, the controller 33 controls so as to stop paper at a position circumventing the above-described paper stop inhibition areas P1 to P7 by appropriately driving the motors 34 to 38 in a form corresponding to the paper jam occurrence position and the paper position responsive to the type and direction of the paper transported at the time. For example, if a paper jam occurs at the paper ejection position of the paper ejection unit 7 when A4-size plain paper is transported as in FIG. 4, paper is stopped at a position as shown in FIG. 6. In the example in FIGS. 4 and 6, when a paper jam occurs, only paper which needs to be moved is transported a predetermined distance and then is stopped and paper which need not be moved is stopped at that position.

However, if a paper jam occurs in the postprocessing unit 3, the occurrence timing becomes an arbitrary timing. Thus, the paper position in the image formation apparatus main unit 2 when the paper jam occurs in the postprocessing unit 3 also becomes an arbitrary position. If so, when the paper jam occurs in the postprocessing unit 3, it is made entirely impossible to keep track of the paper position in the image formation apparatus main unit 2. Consequently, a situation in which the paper stop position cannot appropriately be controlled in the image formation apparatus main unit 2 is caused.

Figure 7:
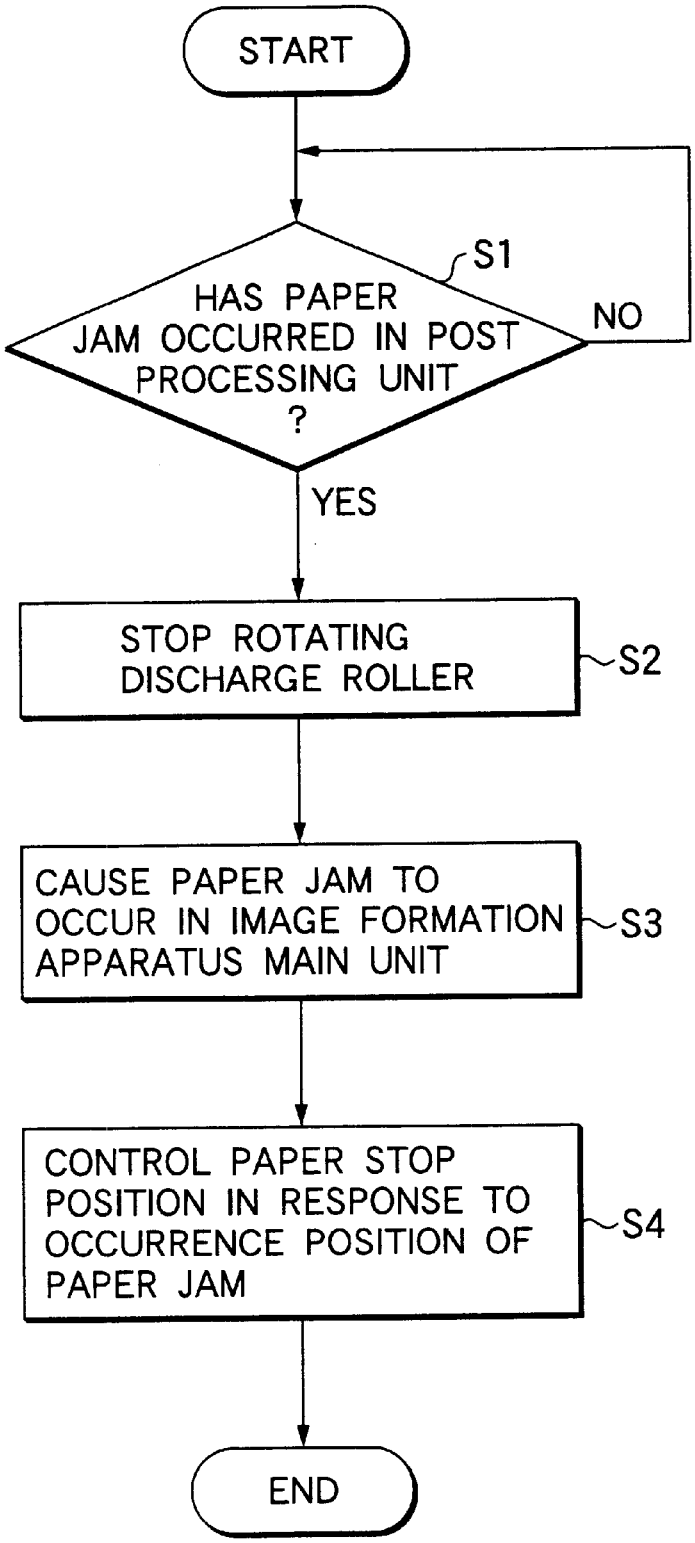
FIG. 7 is a flowchart to show a processing procedure of the image formation apparatus according to the embodiment of the invention.
Figure 8:
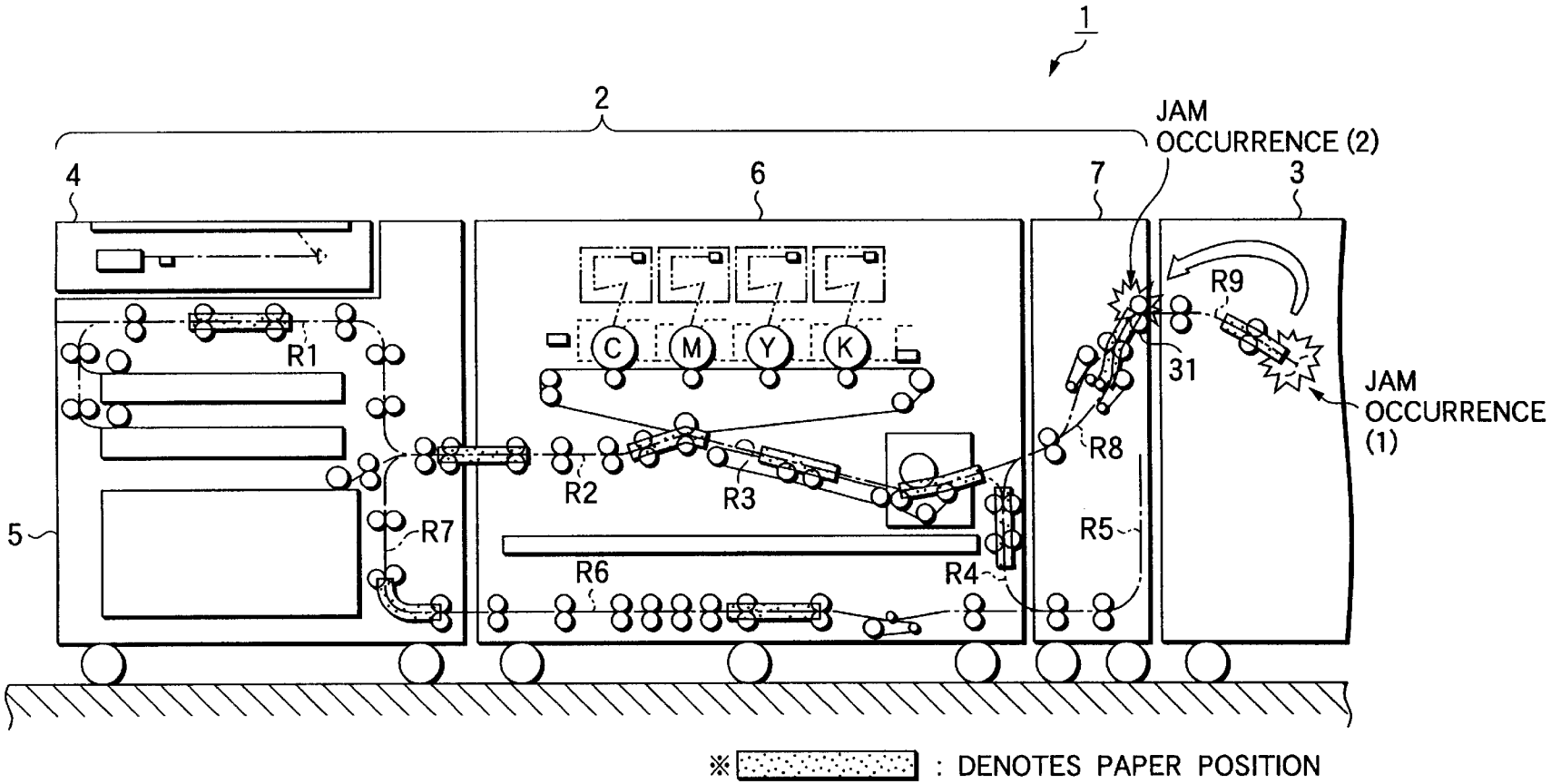
FIG. 8 is a drawing to show a paper jam occurrence situation based on the processing procedure of the image formation apparatus according to the embodiment of the invention.

To circumvent such a situation, the controller 33 performs paper stop position control according to a processing procedure as shown in FIG. 7. FIG. 7 shows a processing mode in which the image formation apparatus main unit 2 is a "first apparatus unit" in the invention and the postprocessing unit 3 is a "second apparatus unit" in the invention.

First, the controller 33 repeatedly determines whether or not a paper jam occurs in the postprocessing unit 3 during the operation of the image formation apparatus 1 (step S1). When a paper jam occurs in the postprocessing unit 3, the paper jam detection section 39 detects the paper jam based on a detection signal from the fourth jam detection sensor 43 and outputs a jam detection signal indicating occurrence of the paper jam to the controller 33. Thus, the controller 33 can determine whether a paper jam occurs or not in the postprocessing unit 3 based on the jam detection signal input from the paper jam detection section 39.

Then, if a paper jam actually occurs in the postprocessing unit 3, the controller 33 stops driving the fourth transport motor 38 and also stop rotating the discharge motor 37 for stopping rotating the discharge rollers 31 (step S2). Accordingly, in the image formation apparatus main unit 2, a move of paper transported along the paper transport passage R8 is blocked by the discharge rollers 31 and thus a paper jam is caused forcibly to occur before (upstream from) the discharge rollers 31 (step S3).

The occurrence position of this paper jam becomes a position preset in the image formation apparatus main unit 2. That is, when paper jam (1) occurs in the postprocessing unit 3, the controller 33 causes paper jam (2) forcibly to occur at the position preset in the image formation apparatus main unit 2. Occurrence of this paper jam (2) is detected by the paper jam detection section 39 based on a detection signal from the third jam detection sensor 42. A jam detection signal indicating occurrence of the paper jam is input from the paper jam detection section 39 to the controller 33. Accordingly, the controller 33 drives the corresponding motor 34, 35, 36 appropriately in response to the occurrence position of the paper jam (2) in the image formation apparatus main unit 2, thereby controlling the paper stop position (step S4).

Thus, when a paper jam occurs in the postprocessing unit 3, rotating the discharge rollers 31 is stopped for causing another paper jam to occur in the image formation apparatus main unit 2, whereby the paper stop position can be appropriately controlled in the image formation apparatus main unit 2 independently of occurrence of the paper jam in the postprocessing unit 3. That is, the paper stop position is controlled based on the paper jam caused to occur by stopping the discharge rollers 31 in the image formation apparatus main unit 2 regardless of the timing at which a paper jam occurs in the postprocessing unit 3, whereby each sheet of paper can be stopped at the appropriate position.

Consequently, if a paper jam occurs in the postprocessing unit 3, the paper stop position may be controlled in the image formation apparatus main unit 2 under the same condition as a paper jam occurs at the paper ejection position of the paper ejection unit 7 as in FIGS. 4 and 6 and thus it is made possible to stop paper at a position circumventing the paper stop inhibition areas P1 to P7 without adopting any complicated control system. Therefore, a secondary fault newly occurring, such as a guillotine phenomenon of paper, can be circumvented. In this connection, if paper does not exist in the image formation apparatus main unit 2 when a paper jam occurs in the postprocessing unit 3, no problem arises if paper transporting is stopped on the spot.

In the embodiment, the steps taken for a paper jam occurring in the postprocessing unit 3 have been described. However, if such an anomaly requiring that paper transporting be stopped, such as a failure in the processing function section of the postprocessing section 3 (collator, stacker, stapler, or the like), occurs in addition to a paper jam, it is also made possible to appropriately control the paper stop position in the image formation apparatus main unit 2 by adopting a processing mode similar to that described above.

Since controlling the paper stop position in the image formation apparatus main unit 2 is performed in response to the occurrence position of a paper jam in the image formation apparatus main unit 2, the position where a paper jam is caused to occur may not necessarily be a position before the discharge rollers 31. However, if the discharge rollers 31 rotate, it is also feared that paper may be delivered from the image formation apparatus main unit 2 to the postprocessing unit 3, causing a new secondary fault to occur, and therefore it is desired that the discharge rollers 31 should be stopped regardless of the position at which a paper jam is caused to occur.

In case that the controller 33 causes a paper jam to occur, it is preferable to perform stop control of stopping the drive roller of the second apparatus unit in addition to stop control of the first apparatus unit. Although the paper stop position in the second apparatus unit is not defined, if the second apparatus unit is designed so as to enable paper to be removed at any paper stop position, paper can always be removed.

Further, in the embodiment, when an anomaly of a paper jam occurs in the postprocessing unit 3, the discharge rollers 31 are stopped for causing a paper jam forcibly to occur in the image formation apparatus main unit 2. However, in addition, for example, the paper jam detection section 39 may recognize occurrence of a paper jam by software in such a manner that paper arrival allowable timing used as a reference for detecting a paper jam in the image formation apparatus main unit 2 is set to an earlier timing than the normal paper arrival allowable timing.

The controller 33 normally has a first paper timing to detect a paper jam based on the fact that paper does not arrive within a predetermined time and a second paper timing earlier than the first paper timing to detect a paper jam when the controller causes a paper jam to occur.

In the embodiment, controlling the paper stop position in the image formation apparatus main unit 2 when an anomaly of a paper jam occurs in the postprocessing unit 3 has been described with the image formation apparatus main unit 2 grasped as the first apparatus unit in the invention and the postprocessing unit 3 grasped as the second apparatus unit in the invention, but the invention is not limited to the mode and can be applied in various manners.

For example, a processing mode can also be adopted wherein when an anomaly of a paper jam occurs in the paper ejection unit 7, a paper jam is caused to occur at a position preset in the image formation unit 6 and the paper stop position in the image formation unit 6 is controlled based on the paper jam with the image formation unit 6 grasped as the first apparatus unit in the invention and the paper ejection unit 7 grasped as the second apparatus unit in the invention. The processing mode enables the paper stop position to be always controlled under the same condition in the image formation unit 6 regardless of the paper jam occurrence position in the paper ejection unit 7.

In addition to the above-mentioned combinations, a similar processing mode to that described above can be adopted in various combinations, for example, in such a manner that the paper feed unit 5 is grasped as the first apparatus unit and the image formation unit 6 is grasped as the second apparatus unit, that the image formation unit 6 is grasped as the first apparatus unit and the paper feed unit 5 is grasped as the second apparatus unit, or that a pair of the image formation unit 6 and the paper ejection unit 7 is grasped as the first apparatus unit and the paper feed unit 5 is grasped as the second apparatus unit. Accordingly, controlling the paper stop position can be simplified drastically, thus making it possible to shorten the apparatus development time period and stabilize the quality.

As described above, according to the image formation apparatus of the invention, when an anomaly requiring that paper transporting be stopped occurs in the second apparatus unit, the controller causes a paper jam to occur in the first apparatus unit, and the controller controls the paper stop position in the first apparatus unit based on the paper jam caused to occur by the controller. Thus, paper can be stopped at the appropriate position in the first apparatus unit regardless of the timing at which an anomaly occurs in the second apparatus unit. Accordingly, in the configuration wherein the postprocessing unit is attached to the image formation apparatus main unit, if an anomaly such as a paper jam occurs in the postprocessing unit, it is made possible to stop paper at the appropriate position in the image formation apparatus main unit. If the image formation apparatus main unit is made up of a plurality of units, it is made possible to drastically simplify controlling the paper stop position when an anomaly occurs.

According to the control method of the image formation apparatus of the invention, when an anomaly requiring that paper transporting be stopped occurs in the second apparatus unit, a paper jam is caused to occur in the first apparatus unit, and the paper stop position in the first apparatus unit is controlled based on the paper jam. Thus, paper can be stopped at the appropriate position in the first apparatus unit regardless of the timing at which an anomaly occurs in the second apparatus unit. Accordingly, in the configuration wherein the postprocessing unit is attached to the image formation apparatus main unit, if an anomaly such as a paper jam occurs in the postprocessing unit, it is made possible to stop paper at the appropriate position in the image formation apparatus main unit. If the image formation apparatus main unit is made up of a plurality of units, it is made possible to drastically simplify controlling the paper stop position when an anomaly occurs.

What is claimed is:

1. An image formation apparatus comprising:

a first apparatus unit having a first paper transport passage;

a second apparatus unit having a second paper transport passage for passing paper to/from the first paper transport passage; and a controller, wherein the controller causes a paper jam to occur in the first apparatus unit when an anomaly requiring that paper transporting be stopped in the second apparatus unit; and the controller controls a paper stop position in the first apparatus unit based on the paper jam caused to occur.

2. The image formation apparatus according to claim 1, wherein the controller causes the paper jam to occur at a position preset in the first apparatus unit.

3. The image formation apparatus according to claim 1, wherein the first apparatus unit comprises a plurality of paper transport sections for transporting paper along the first paper transport passage; and the controller causes a paper jam to occur in the first apparatus unit by stopping driving the paper transport section at the last stage for passing paper to the second apparatus unit.

4. The image formation apparatus according to claim 1, wherein the first apparatus unit is a main unit of the image formation apparatus; and the second apparatus unit is a postprocessing unit attached to the main unit of the image formation apparatus.

5. The image formation apparatus according to claim 1, wherein the first apparatus unit comprises a plurality of paper transport sections for transporting paper along the first paper transport passage; and the controller stops driving the paper transport section at the last stage for passing paper to the second apparatus unit regardless of the occurrence position of the paper jam caused to occur by the controller.

6. The image formation apparatus according to claim 1, wherein the controller has a first paper timing for detecting a paper jam based on the fact that paper does not arrive within a predetermined time and a second paper timing earlier than the first paper timing for causing a paper jam to occur by the controller.

7. The image formation apparatus according to claim 1, wherein the second apparatus unit comprises a plurality of paper transport sections for transporting paper along the second paper transport passage; and when the controller causes a paper jam to occur, the controller stops the paper transport sections of the second apparatus unit.

8. A control method of an image formation apparatus comprising a first apparatus unit having a first paper transport passage and a second apparatus unit having a second paper transport passage for passing paper to/from the first paper transport passage, the control method comprising the steps of:

causing a paper jam to occur in the first apparatus unit when an anomaly requiring that paper transporting be stopped in the second apparatus unit; and controlling a paper stop position in the first apparatus unit based on the paper jam.

9. The control method according to claim 8, wherein when the step of causing the paper jam causes the paper jam to occur at a position preset in the first apparatus unit.

10. The control method according to claim 8, wherein when the step of causing the paper jam causes the paper jam to occur by stopping driving a paper transport section at the last stage for passing paper to the second apparatus unit.

11. The control method according to claim 8, wherein the first apparatus unit is a main unit of the image formation apparatus; and the second apparatus unit is a postprocessing unit attached to the main unit of the image formation apparatus.

12. The control method according to claim 8, further comprising the steps of determining whether a paper jam occurs in the second apparatus unit.

* * * * *